United States Patent [19]

LeBlanc, Jr.

[11] Patent Number: 4,990,114

[45] Date of Patent: Feb. 5, 1991

[54] INFLATABLE RESCUE RAMP

[76] Inventor: George W. LeBlanc, Jr., 16 Atlantic St., Lynn, Mass. 01902

[21] Appl. No.: 404,171

[22] Filed: Sep. 7, 1989

[51] Int. Cl.[5] ..... B63C 9/32

[52] U.S. Cl. ..... 441/80; 14/27; 441/82

[58] Field of Search ..... 441/40–42, 441/80, 82, 84, 85, 129; 14/27; 182/48; 193/25 B; 114/345; 244/905

[56] References Cited

U.S. PATENT DOCUMENTS

| | | | |
|---|---|---|---|
| 1,205,033 | 11/1916 | Seely | 441/42 |
| 2,370,069 | 2/1945 | Patten | 114/345 |
| 3,992,739 | 11/1976 | Stevens et al. | 441/85 |
| 4,047,257 | 9/1977 | Bondarchuk, Sr. | 14/27 |

*Primary Examiner*—Sherman Basinger

[57] ABSTRACT

The invention provides an inflatable rescue ramp having a pair of spaced inflatable tubes which join at one end to define a bow. A flexible web is mounted between and connects to the tubes at outside seams. That is, the web passes under each tube and is attached thereto on outside longitudinal seams, such that downward pressure on the web or ramp floor will cause adjacent portions of the tubes to axially rotate outwardly from each other to provide and enhance passageway on the web between the tubes. The rescue ramp is carried to the scene in a folded and compact state, with the above tubes being connected to a compressed air source. The rescue ramp is positioned on or near a firm surface and pointed toward a victim on an unfirm surface e.g. in an icy pond and the tubes inflated causing the ramp to pop or snake out of its packed condition and extend toward the victim with anchor lines from the tubes trailing. The rescuers grab the anchor lines and aim or position the inflating or inflated rescue ram in the direction of the victim and then secure the anchor lines and the near end of the rescue ramp on or near a firm surface e.g. the shore of a pond, whereupon a rescuer can hurry out on the so-positioned ramp to aid the victim. Subsequently the rescue ramp is deflated, folded and packed for future use.

10 Claims, 5 Drawing Sheets

INFLATABLE RESCUE RAMP

BACKGROUND OF THE INVENTION

1. Field of the Invention

This invention relates to a rescue device, particularly a rescue ramp for use on unfirm surfaces.

2. The Prior Art

Boat rescues of persons or animals in distress can take too much time over a body of water and be even slower over thin ice, increasing the jeopardy and discomfort of such a victim, when, due to problems such as hypothermia, seconds count. Accordingly, a rescue ramp has been proposed, which with one end anchored to shore, unrolls over the snow, ice, water or other unfirm surface toward the victim, in hopes of hauling him onto such ramp in a timely manner. See for example, U.S. Pat. No. 4,047,257 (1977). This device is basically a rolled up snow fence terminating in a floating core when unrolled. In a different field, an inflatable floating bridge has been proposed in U.S. Pat. No. 4,106,149 (1978). The bridge has two spaced-apart inflatable air hoses connected by e.g. a plastic sheet, which has numerous transverse load distributing elements such as ribs or rods to keep the hoses apart when the ramp is under load e.g. of the weight of one or more persons thereon.

Thus both prior art ramps are stiff and heavy with ribs. Further, incorporating such ribs in the inflatable floating bridge makes for a complicated structure, wherein the ends of the ribs can cause local stress on the plastic sheet and wear against it as noted in column 2, lines 44 to 48 of the above second reference.

There is, therefore, a need and market for a rescue ramp that is lighter in weight, less complex in construction, less susceptible to local stress and wear and otherwise obviates the above prior art shortcomings.

There has now been discovered a rescue ramp that dispenses with or avoids the use of transverse ribs therein, that is of streamlined, uncomplex construction, that is lightweight and readily portable, pointable, stable and durable and which rapidly deploys over an unfirm surface to readily reach a victim. The ramp of the present invention may be shifted in direction during or after the inflation thereof and anchored on or near shore or other support surface to facilitate the rescue.

SUMMARY

Broadly the present invention provides an inflatable rescue ramp comprising, a pair of spaced inflatable tubes, a flexible web there-between, defining a passageway between said tubes, said web passing under and being attached to the tubes on outside longitudinal seams thereof, such that downward pressure on the web passage will cause said tubes to axially rotate outwardly of each other, maintaining a substantial separation between the tubes and providing a passageway there-between under load.

By "unfirm surface" as used herein, is meant swamp land, water, thin ice, snow, other unstable surfaces or a combination thereof.

BRIEF DESCRIPTION OF THE DRAWINGS

The invention will become more apparent from the following detailed Specification and drawings in which.

DESCRIPTION OF PREFERRED EMBODIMENT

Figure 1:
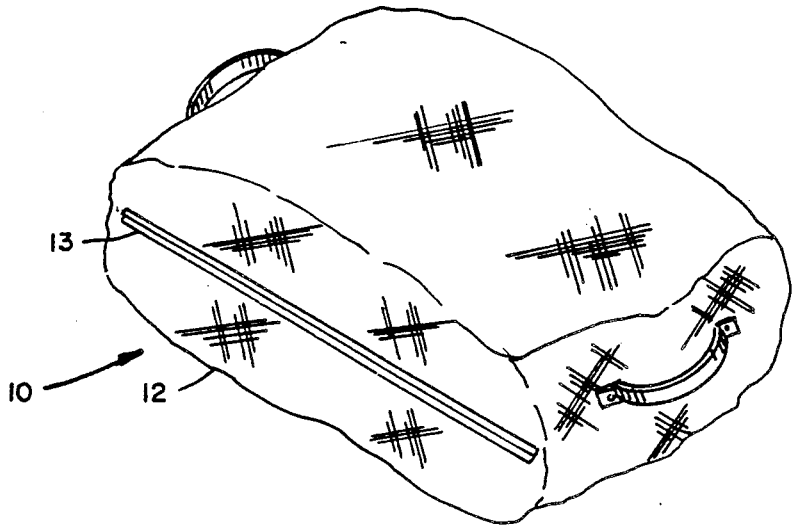
FIG. 1 is a perspective view of the rescue ramp embodying the invention in compact form.
Figure 2:
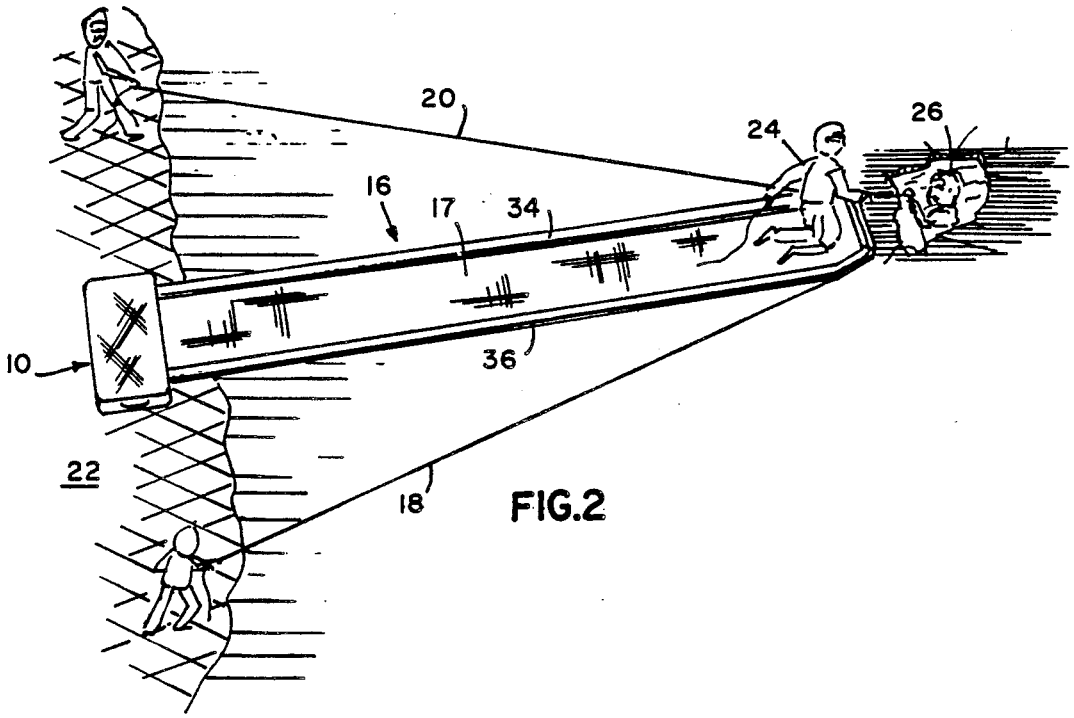
FIG. 2 is a perspective vie-w of the rescue ramp embodying the present invention in use.

Referring in more detail to the drawings, compact rescue ramp 10 stored in a carrying bag 12, is brought to the water's edge, pointed at the victim, inflated in seconds to lengths of up to 150 feet, to form an extended ramp 16 and further pointed and then secured by anchor lines 18 and 20 to the shore 22, as shown in FIGS. 1 and 2. The rescuer 24 then walks out on the ramp to grab the victim 26 and to haul him onto the ramp and to safety, as indicated in FIG. 2.

Figure 3:
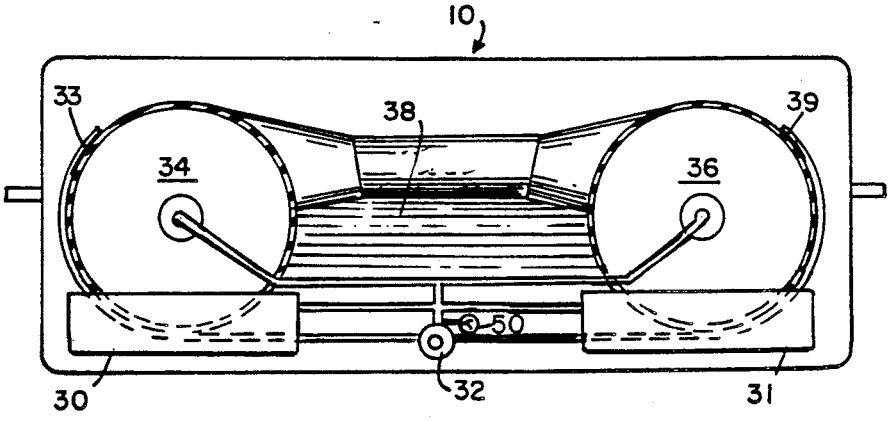
FIG. 3 is a rear sectional elevation view of the invention embodiment of FIG. 1.
Figure 4:
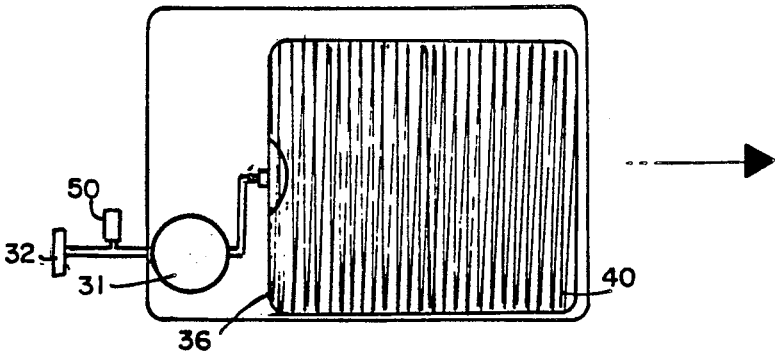
FIG. 4 is a side sectional elevation view of the invention embodiment of FIG. 1.
Figure 5:
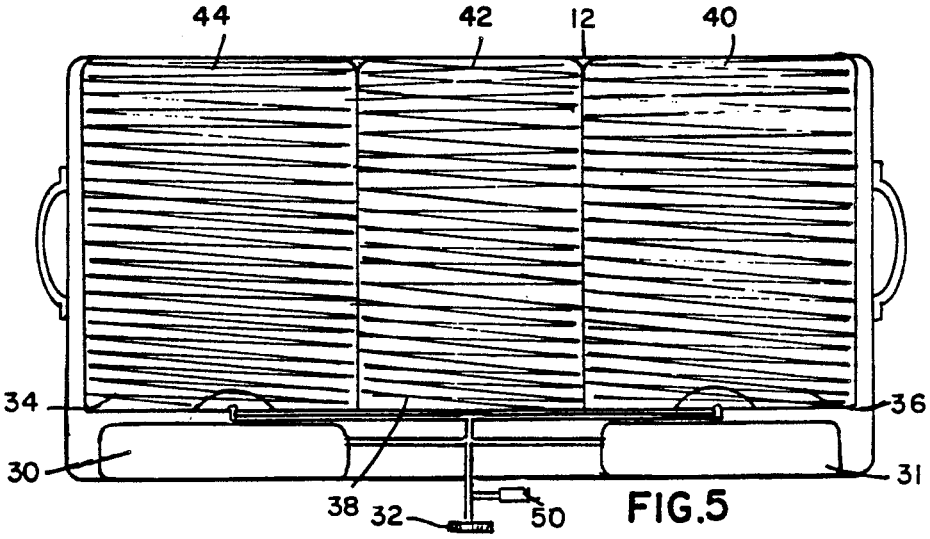
FIG. 5 is a top sectional elevation view of the embodiment of FIG. 1.
Figure 6:
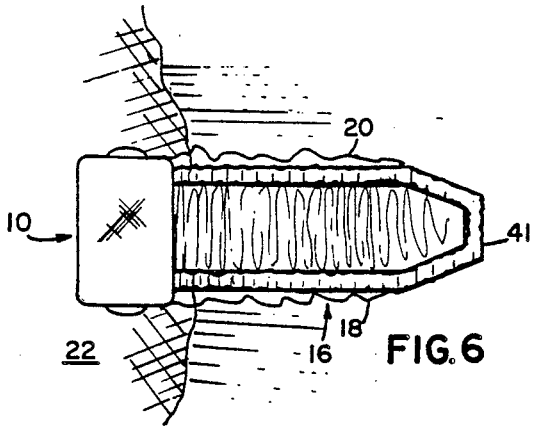
FIGS. 6, 7 and 8 are plan views of the inflatable rescue ramp embodying the invention during inflation.
Figure 7:
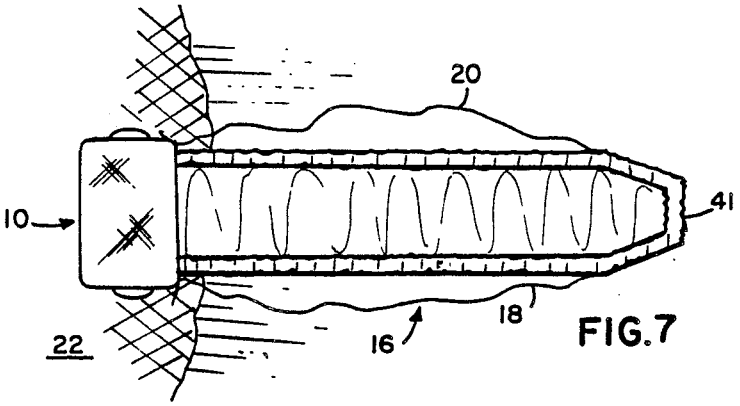

The rescue ramp in its uninflated and folded state 10 is shown in the elevation views of FIGS. 3 and 4 and the plan view of FIG. 5, in which compressed air bottles 30 and 31, activated by external valve 32, connects to the two inflatable tubes 34 and 36, having the folded web 38 there-between, all in the bag 12 as shown in FIGS. 3, 4 and 5. The inflatable tubes 34 and 36 and the ramp 38 are folded accordian style, within the bag 12, e.g. in pleats 40, 42 and 44, as best shown in FIGS. 5 and 4.

In operation, the ramp bag 12 is positioned on shore near the water's edge and pointed toward the victim and the is opened e.g. at the velcro strip 13 (FIG. 1). The valve 32 is then opened and in e.g. 22 seconds the ramp tubes 34 and 36 are inflated, popping the rescue ramp 16 with web or floor 17, out of its bag toward the victim, to its extended length of e.g. 50 feet, 100 feet, 150 feet or more, as shown in FIGS. 6, 7, 8 and 9. The extended ramp 16 thus inflated, is pointed more closely to the victim and the anchor lines 18 and 20 secured as discussed above. The rescuer hurries out to the victim as noted above with respect to FIG. 2.

Figure 13:
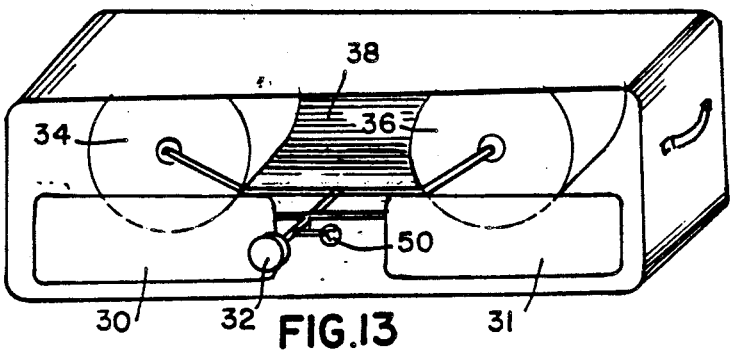
FIG. 13 is a schematic perspective view of components of the invention shown in FIG. 3 and FIG. 14 and 15 are fragmentary perspective views of components of the inflatable rescue ramp embodying the invention.

The pressure (and rate) at which the ramp tubes inflate, is controlled by pressure valve 32, as shown in FIGS. 3 and 13. In addition, gauge 50 can be added to the gas pipe system 52, as shown in FIG. 13, for pressure monitoring purposes, either when the rescue ramp is in storage or during inflation thereof.

Figure 10:
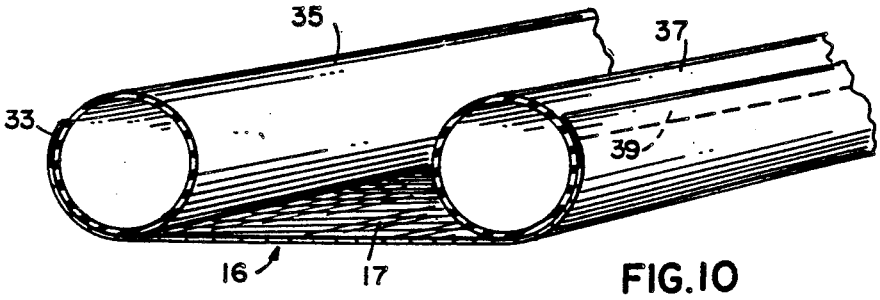
FIG. 10 is a schematic fragmentary perspective view of a portion of the inflatable rescue ramp embodying the present invention.
Figure 14:
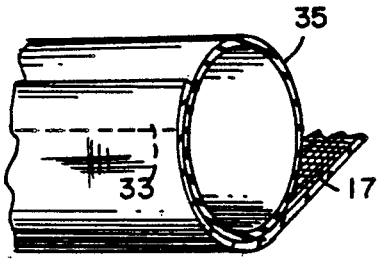
Figure 15:
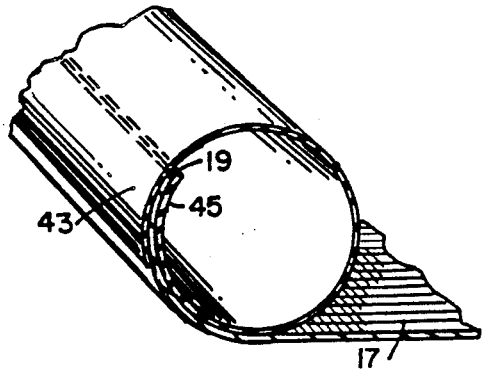

In addition to the ribless ramp web or floor 17 of the invention, a further novel feature is the way that the ramp floor 17 is attached to the ramp tubes 35 and 37, shown in FIG. 10. That is, the ramp floor 17 is attached to an outer side of tube 35 at seam 33 and/an outer side of tube 37 at seam 39, as shown in FIGS. 10 and 14. An alternative outside seam is shown in FIG. 15 in which the ramp floor edge 19 is sandwiched between the tube-forming edges 43 and 45 in a tri-laminate seam. Accordingly, when the rescuer 24 walks on the ramp floor 17, the pressure of his weight will cause the tubes 35 and 37 to turn outwardly away from the center of the ramp floor 17, enhancing his passageway as he walks along such ramp floor 17, as indicated in FIG. 10.

Figure 8:
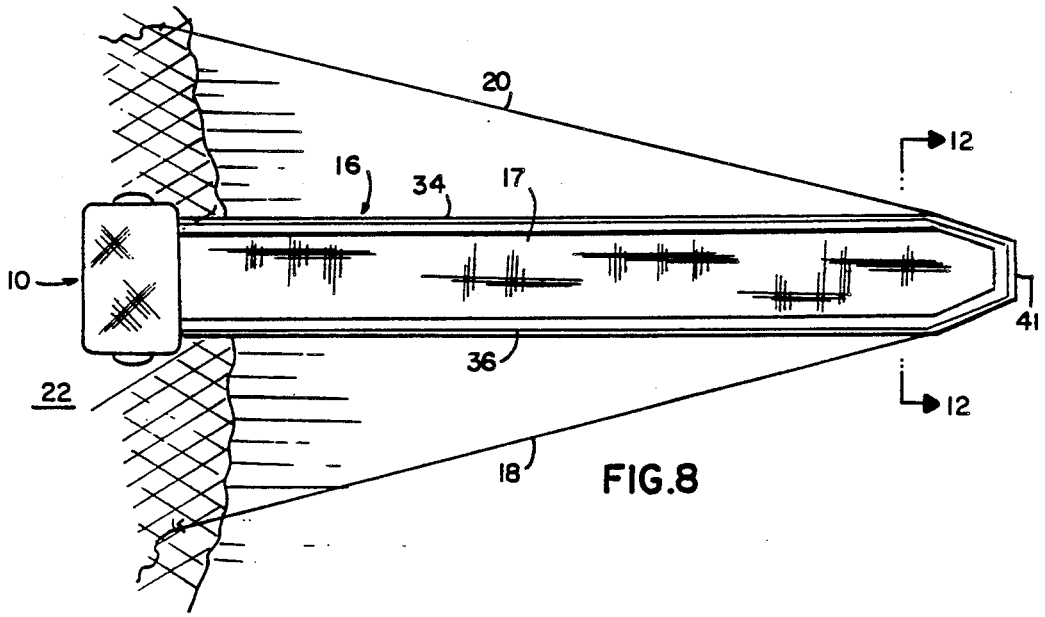
Figure 9:
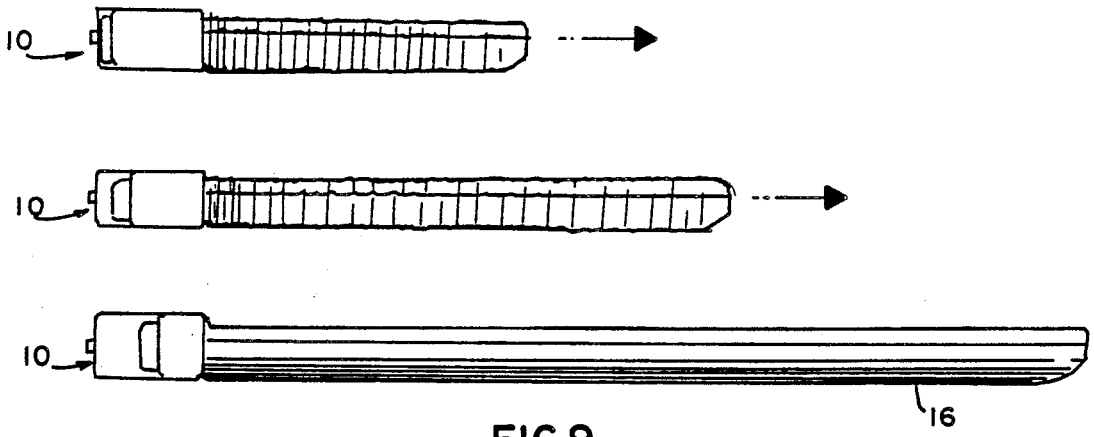
FIG. 9 is a side elevation view of the inflatable rescue ramp embodiment of the invention during inflation.
Figure 11:
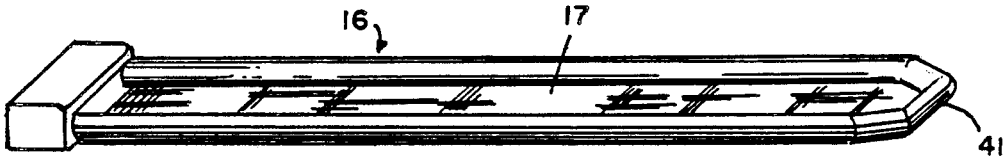
FIG. 11 is a side elevation view of the inflatable rescue ramp embodying the invention.
Figure 12:
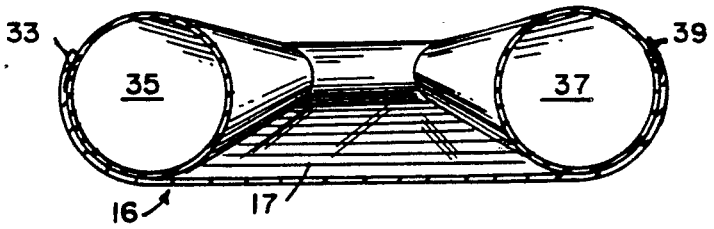
FIG. 12 is a cross-sectional elevation view of the inflatable rescue ramp embodying the present invention taken on lines 12—12 of FIG. 8, looking in the direction of the arrows.

Desirably the tubes 35 and 37 form a three-sided or blunt bow 41, as shown in FIGS. 8 and 13. The ramp floor 17 thus extends and is fastened to the outside of the tubes 35 and 37 all the way to the end of the bow 41, as indicated in the cross-sectional elevation view of FIG. 12. An elevation view of the outside ramp floor tubular seam 39, reaching the whole length of the extended ice ramp from bag 12 to the point of the bow 41 is shown in FIG. 11.

Such ramp floor outside tube seams 33 and 39 is an important novelty of the invention in that were the ramp floor connected to e.g. the bottom center of each of the tubes 35 and 37, the weight of a person walking on such ramp floor, particularly over water, would sink the central portion of the ramp floor and bring the tubes 35 and 37 close together, impeding the walkway of the ramp floor 17. With the outside ramp floor seam construction of the present invention, the weight of the walker on the ramp floor rotates the adjacent portions of the tubes 35 and 37 outwardly, to bring the tubes 35 and 37 less close together, to provide unimpeded walkway access for the rescuer and the rescued.

The web or floor of the rescue ramp as well as the inflatable tubes, can be single or multi-ply and made of plastic, rubber or a combination thereof, e.g. a rubber-nylon-rubber laminate is a preferred material for both ramp floor and tubes. By "nylon" is meant a polyamide. If desired an inner tube of rubber or plastic can be placed within the outer plastic inflatable tubes.

The ramp can inflate up to any desired length e.g. 50 feet, 100 feet, 150 feet or more, as desired according to the application within the scope of the present invention.

The inflatable rescue ramp of the present invention can be compacted after deflation, by rolling into an annular shape, or folded into such compact shape as desired, within the present invention.

The rescue ramp embodying the present invention is inflated by gas, e.g. compressed gas and preferably compresssed air. However other gas sources can be employed as desired within the present invention.

The rescue ramp of the invention can inflate front-to-back or back-to-front as desired, within the scope of the invention and preferably inflates back to front.

The rescue ramp of the invention desirably has a bow or end wall when inflated, according to the invention and preferably has a pointed bow.

The rescue ramp of the invention when inflated, is desirably guided, pointed and anchored by a plurality of anchor lines of two or more, though these lines can be dispensed with, within the scope of the present invention.

The web or floor of the rescue ramp of the invention is attached as discussed above, to the inflatable tubes and outside lontitudinal seams thereof by one or more longitudinal bonding means e.g. adhesive, stitching, heat bonding or other means or a combination thereof.

What is claimed is:

1. An inflatable rescue ramp comprising, a pair of spaced inflatable tubes, each said tube having an inner side and an outer side, and a flexible web, said flexible web extending between said inner sides of said tubes and defining a passageway between said tubes, said web having portions extending laterally and passing under said tubes and being attached to said outer sides of said tubes along a respective longitudinally extending seam , said web being substantially unattached to said tubes except along said longitudinally extending seam such that downward pressure on the web passageway causes said tubes to axially rotate outwardly of each other, maintaining a substantial separation between said tubes and providing a passageway there-between under load.

2. The rescue ramp of claim 1, having a bow.

3. The rescue ramp of claim 2, in which said tubes join at one end to define said bow.

4. The rescue ramp of claim 1, in which anchor lines extend on either side thereof for pointing and anchoring said ramp relative to the shore or other support surface.

5. The rescue ramp of claim 1, being packed in its uninflated state into a compact unit.

6. The rescue ramp of claim 5, being folded accordian style into said compact unit.

7. The rescue ramp of claim 5, in which said tubes are connected to a compressed gas source.

8. The rescue ramp of claim 7, in which said ramp is so packed that upon inflation of the tubes, the bow thereof pops out first followed by the remainder of the ram being inflated in the desired direction, with trailing anchor lines for guiding, pointing and anchoring the ramp thus inflated.

9. The rescue ramp of claim 1, in which said flexible web between said tubes is free of lateral reinforcement sections.

10. An inflatable rescue ramp comprising a pair of spaced inflatable tubes which join at one end to define a bow, each said tube having an inner and an outer side and a flexible web extending laterally between said tubes and connected to said tubes, said web having a portion thereof passing under and being attached to at least one of said tubes at the outer side of said one tube along a longitudinally extending seam, said web being substantially unattached to said one tube except along longitudinally extending seam, such that downward pressure on said web causes said oen tube to tend to rotate away from the center of said web, to thus provide an enhanced passageway on said web between said tubes.

* * * * *